US008367594B2

(12) United States Patent
Mikhaylichenko

(10) Patent No.: US 8,367,594 B2
(45) Date of Patent: Feb. 5, 2013

(54) DAMAGE FREE, HIGH-EFFICIENCY, PARTICLE REMOVAL CLEANER COMPRISING POLYVINYL ALCOHOL PARTICLES

(75) Inventor: Katrina Mikhaylichenko, San Jose, CA (US)

(73) Assignee: LAM Research Corporation, Fremont, CA (US)

( * ) Notice: Subject to any disclaimer, the term of this patent is extended or adjusted under 35 U.S.C. 154(b) by 477 days.

(21) Appl. No.: 12/491,213

(22) Filed: Jun. 24, 2009

(65) Prior Publication Data

US 2010/0331226 A1 Dec. 30, 2010

(51) Int. Cl.
*C11D 3/37* (2006.01)

(52) U.S. Cl. ..... 510/175; 510/418; 510/475; 134/1.2; 134/1.3

(58) Field of Classification Search ..... 510/175, 510/418, 475; 134/1.2, 1.3
See application file for complete search history.

(56) References Cited

U.S. PATENT DOCUMENTS

| | | | | |
|---|---|---|---|---|
| 3,819,525 | A * | 6/1974 | Hattenbrun | 510/139 |
| 4,279,752 | A | 7/1981 | Sueoka et al. | |
| 4,777,089 | A * | 10/1988 | Takizawa et al. | 428/402.22 |
| 4,898,781 | A * | 2/1990 | Onouchi et al. | 428/402.22 |
| 5,281,357 | A * | 1/1994 | Morgan et al. | 510/393 |
| 7,014,669 | B2 * | 3/2006 | Small et al. | 51/307 |
| 7,799,752 | B2 * | 9/2010 | Ness et al. | 512/4 |
| 7,915,215 | B2 * | 3/2011 | Bobnock | 510/418 |
| 2005/0054203 | A1 * | 3/2005 | Yamada | 438/695 |
| 2005/0136670 | A1 * | 6/2005 | Ameen et al. | 438/691 |
| 2005/0194562 | A1 * | 9/2005 | Lavoie et al. | 252/79.1 |
| 2006/0128590 | A1 | 6/2006 | Freer et al. | |
| 2006/0213536 | A1 | 9/2006 | Sato | |
| 2008/0045016 | A1 * | 2/2008 | Andou et al. | 438/692 |
| 2009/0151752 | A1 * | 6/2009 | Mui et al. | 134/21 |
| 2009/0156008 | A1 * | 6/2009 | Sakamoto | 438/693 |
| 2010/0120647 | A1 * | 5/2010 | Zhu et al. | 510/175 |

OTHER PUBLICATIONS

PCT International Search Report—dated Aug. 20, 2010 (2 pages).

* cited by examiner

*Primary Examiner* — Charles Boyer
(74) *Attorney, Agent, or Firm* — Martine Penilla Group, LLP

(57) ABSTRACT

A system, method and an apparatus to remove contaminants from a semiconductor substrate surface includes application of a cleaning material. The cleaning material includes a cleaning solution and a plurality of micron-sized dry polyvinyl particles dispersed in the cleaning solution. The cleaning solution is a single phase polymeric compound that is made of long polymeric chains and exhibits distinct viscoelastic properties. The plurality of micron-sized dry polyvinyl alcohol particles absorb the liquid in the cleaning solution and become uniformly suspended within the cleaning material. The suspended polyvinyl alcohol particles interact with at least some of contaminants on the semiconductor substrate surface to release and remove the contaminants from the substrate surface. The released contaminants are entrapped within the cleaning material and removed with the cleaning material leaving behind a substantially clean substrate surface.

16 Claims, 7 Drawing Sheets

DAMAGE FREE, HIGH-EFFICIENCY, PARTICLE REMOVAL CLEANER COMPRISING POLYVINYL ALCOHOL PARTICLES

CROSS REFERENCE TO RELATED APPLICATIONS

This application is related to U.S. patent application Ser. No. 12/131,654, filed on Jun. 2, 2008, entitled "Materials for Particle Removal by Single-Phase and Two-Phase Media," U.S. patent application Ser. No. 12/131,660, filed on Jun. 2, 2008, entitled "Methods for Particle Removal by Single-Phase and Two-Phase Media," U.S. patent application Ser. No. 12/131,667, filed on Jun. 2, 2008, entitled "Apparatus for Particle Removal by Single-Phase and Two-Phase Media." This application is also related to U.S. patent application Ser. No. 11/532,491, filed on Sep. 15, 2006, entitled "Method and Material for Cleaning a Substrate," U.S. patent application Ser. No. 11/532,493, filed on Sep. 15, 2006, entitled "Apparatus and System for Cleaning a Substrate," and U.S. patent application Ser. No. 11/641,362, filed on Dec. 18, 2006, entitled "Substrate Preparation Using Stabilized Fluid Solutions and Methods for Making Stable Fluid Solutions." The disclosure of each of the above-identified related applications is incorporated herein by reference.

FIELD OF THE INVENTION

The present invention relates generally to semiconductor substrate processing, and more particularly, to systems and methods for providing an efficient damage-free particle removal clean using specialty chemical formulation.

DESCRIPTION OF THE RELATED ART

Semiconductor devices are obtained through various fabrication operations. During the various fabrication operations, a substrate is exposed to various contaminants including any material or chemical used in the fabrication operations. Chemicals used in the various fabrication operations, such as etching, deposition, etc., leave particulates or polymer residue contaminants on and around the semiconductor devices formed on the surface of the substrate. The sizes of the particle contaminants are in the order of the critical dimensions or larger than the critical dimensions of the devices and features being fabricated on the substrate surface. As the size of semiconductor devices becomes smaller, it is becoming increasingly difficult to remove particles from the surface of the substrate without causing damage to the devices formed thereon.

In some embodiments, mechanical energy is used to remove the contaminants from the surface of the substrate. However, it is common knowledge that applying mechanical energy causes semiconductor devices to collapse. Novel semiconductor substrate treatment concept using specialty chemical formulation has been known to rid the surface of the substrate off the contaminants causing minimal damage to the semiconductor devices. With specialty chemical formulation, particle removal efficiency (PRE) depends on how the chemical formulation is applied and removed from the surface of the substrate. The choice of the specialty chemical formulation strongly depends on the type of substrate and type of particles that need to be removed. Typical PRE value using specialty formulation is of the order of about 90%. Although this is a high PRE value, it should be understood that the remaining 10% of contaminants are left behind on the substrate after a cleaning operation. This 10% of particle contaminants may result in significant yield drop and, therefore, have to be removed prior to a subsequent process operation.

The aforementioned PRE value reflects the optimum results in a perfect cleaning environment. In reality, the PRE value can be much lower (as low as 40-50%) than the above estimate leading to thousands of contaminants remaining on the surface of the substrate potentially resulting in significant yield loss.

In view of the foregoing, a more effective cleaning technology is needed in removing the contaminants from the surface of the substrate while preserving the structural integrity of the semiconductor devices. It is in this context embodiments of the invention arise.

SUMMARY

Broadly speaking, the embodiments fill the need by providing improved substrate-cleaning techniques for removing contaminants from the substrate surface without mechanical damage to the device features formed on the substrate surface. The substrate cleaning techniques utilize a cleaning material that includes dry PVA particles dispersed in a cleaning solution. Upon immersion in a cleaning solution, PVA particles absorb water and the PVA material gets hydrolyzed. When the cleaning material is applied to the surface of the substrate, the PVA particles interact with the contaminants and exert additional shear force that act as levers to break the bond between the contaminants and the surface of the substrate. The long chain polymers of the cleaning solution and the PVA particles entrap the released contaminants. The entrapped contaminants are removed from the surface of the substrate along with the cleaning material, leaving behind a substantially clean substrate surface. The PVA particles are small micron-sized particles that act as soft micro brushes that work gently to release the contaminants from the surface of the substrate. The soft, sponge-like nature of the PVA particles gently works to remove the contaminants without impacting the adjacent features and devices. The micron-scale size of the particles enable the cleaning material to reach into areas in between closely formed features and remove the contaminants resulting in a substantially clean substrate surface.

It should be appreciated that the present invention can be implemented in numerous ways, including as a material (or solution), a method, a process, an apparatus, or a system. Several inventive embodiments of the present invention are described below.

In one embodiment, a cleaning material to remove contaminants from a semiconductor substrate surface is provided. The cleaning material includes a cleaning solution and a plurality of micron-scale_sized dry polyvinyl alcohol (PVA) particles dispersed in the cleaning solution. The cleaning solution exhibits distinct viscoelastic properties. The cleaning solution is a single phase polymeric compound that is made of long polymeric chains. The plurality of micron-sized dry polyvinyl alcohol particles absorb the liquid in the cleaning solution and become uniformly suspended within the cleaning material. The suspended PVA particles interact with at least some of the contaminants on the semiconductor substrate surface to release and remove the contaminants from the substrate surface. The released contaminants are entrapped within the cleaning material.

In another embodiment, an apparatus for cleaning contaminants from a surface of a semiconductor substrate is provided. The apparatus includes a substrate supporting mechanism for receiving, holding and transporting the semiconductor substrate along a plane. The apparatus also includes a cleaning material dispenser for applying a cleaning material to clean the contaminants from the substrate surface. The cleaning material contains a cleaning solution and a plurality of micron-scale sized polyvinyl alcohol (PVA) particles dispersed in the cleaning solution. The cleaning solution is a single phase polymeric compound with long polymeric chains exhibiting distinct viscoelastic properties. The dry PVA particles absorb liquid in the cleaning solution and become uniformly suspended within the cleaning material. The suspended PVA particles interact with at least some of the contaminants to release the contaminants from the surface of the substrate. The released contaminants are entrapped within the cleaning material leaving behind a substantially clean substrate surface.

In yet another embodiment, a method to remove contaminants from a substrate surface of a semiconductor substrate is provided. The method includes placing the semiconductor substrate in a cleaning apparatus. A cleaning material is dispensed for cleaning the contaminants from the substrate surface. The cleaning material contains a cleaning solution and a plurality of micron-scale sized dry polyvinyl alcohol (PVA) particles dispersed in the cleaning solution. The cleaning solution is a single phase polymeric compound with long polymer chains that exhibit viscoelastic properties. The dry PVA particles absorb liquid from the cleaning solution and become uniformly suspended within the cleaning material. The plurality of PVA particles interacts with at least some of the contaminants on the semiconductor substrate surface to release the contaminants from the substrate surface. The released contaminants are entrapped in the cleaning material.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention will be readily understood by reference to the following description taken in conjunction with the accompanying drawings. These drawings should not be taken to limit the invention to the preferred embodiments, but are for explanation and understanding only. Like reference numerals designate like structural elements.

DETAILED DESCRIPTION

Figure 1:
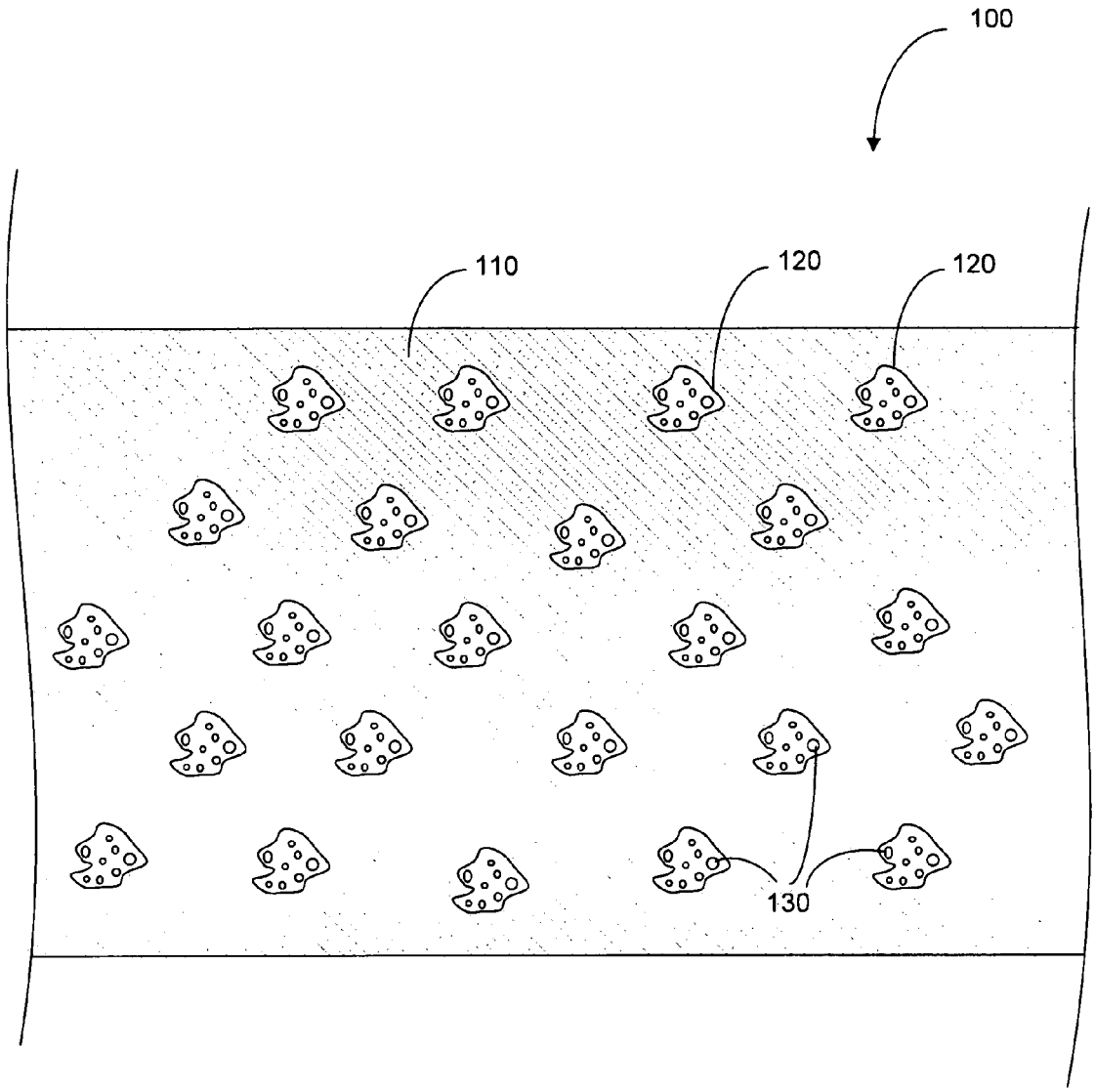
FIG. 1 illustrates a simplified physical diagram of a cleaning material used to remove contaminants from a surface of a substrate, in one embodiment of the invention.

Several embodiments for efficiently removing contaminants from a surface of a substrate and increasing particle removal efficiency without damage, during a cleaning operation will now be described. It will be obvious, however, to one skilled in the art, that the present invention may be practiced without some or all of these specific details. In other instances, well known process operations have not been described in detail in order not to unnecessarily obscure the present invention.

Effective removal of contaminants from a surface of a substrate helps in retaining the functionality of the features formed on the substrate surface and of the resulting semiconductor devices. It becomes increasingly more difficult to remove particles for smaller technology nodes without mechanical damage. In one embodiment of the invention, an enhanced cleaning material is used in cleaning the surface of the substrate. The cleaning material includes a cleaning solution made of a polymeric compound with long polymeric chains. The cleaning solution, containing polymers of a polymeric compound with large molecular weight, capture the contaminants on the substrate. In addition, the cleaning materials entrap the contaminants and do not return the contaminants to the substrate surface. The polymers of a polymeric compound with large molecular weight form long polymer chains, which can also be cross-linked to form a network (or polymeric network). The length of the polymer chains for polymers that are not substantially cross-linked or almost not cross-linked can be estimated by dividing the molecular weight of the polymers by the molecular weight of the monomeric species (length~(molecular weight of polymer)/(weight of monomer)). The long polymer chains and/or polymer network show superior capabilities of capturing and entrapping contaminants, in comparison to conventional cleaning materials. The cleaning solution exhibits distinct viscoelastic properties. A plurality of micron-sized dry PVA particles is dispersed in the cleaning solution to form the cleaning material. The PVA particles absorb liquid from the cleaning solution and get uniformly suspended in the cleaning solution. When the cleaning material is applied to the surface of the substrate, the PVA particles interact with the contaminants to release the contaminants from the substrate surface. The released contaminants are entrapped in the cleaning material and removed along with the cleaning material, leaving behind a substantially clean substrate surface.

Conventional substrate cleaning apparatus and methods include brushes and pads utilizing mechanical forces in removing particulates from the substrate surface. For advanced technologies with device structures with narrow widths and high aspect ratios, the mechanical forces applied by the brushes and pads can damage the device structures. In addition, the harsh brushes and pads may also cause scratches on the substrate surface. Cleaning techniques, such as megasonic cleaning and ultrasonic cleaning, utilizing cavitation bubbles and acoustic streaming to clean substrate can also damage fragile structures. Cleaning techniques using jets and sprays can cause erosion of films and can also damage fragile structures. Some cleaning materials include abrasive solids in the cleaning materials to assist cleaning. For advanced technologies with fine features, the abrasive solids in the cleaning materials can cause damage to the device structures.

The small size of the PVA particles enables the cleaning material to remove contaminant particles from the surface of the substrate and the features without introducing mechanical damage to the features and the substrate surface. Further, the PVA particles absorb liquid in the cleaning solution and are uniformly suspended within the polymeric chains of the cleaning solution. The PVA particles behave as soft micro-brushes that apply additional energy to the surface of the substrate and work towards breaking the bond between the contaminants and the surface of the substrate thereby releasing the contaminants without damaging the features formed nearby. The released contaminants are entrapped in the long polymeric chains of the cleaning solution or in the PVA particles. The entrapped contaminants are removed along with the cleaning material. The PVA particles provide additional particle removal mechanism that works in parallel with the normal mechanism of particle removal exhibited by the cleaning solution thereby enhancing the particle removal efficiency at the substrate surface.

FIG. 1 illustrates a physical diagram of a cleaning material 100 used in removing contaminants from a substrate surface. The cleaning material 100 includes a cleaning solution 110 and a plurality of micron-scale sized PVA particles 120. The cleaning solution is made of a polymeric compound with long polymeric chains that exhibits distinct viscoelastic properties. The cleaning solution, in one embodiment, is a single phase compound. The long polymeric chains of the cleaning solution provide unique capability of capturing and entrapping contaminants and PVA particles. For details about the type of polymeric compound that can be used in the cleaning solution, reference can be made to U.S. patent application Ser. No. 12/131,654, filed on Jun. 2, 2008, entitled "Materials for Particle Removal by Single-Phase and Two-Phase Media," U.S. patent application Ser. No. 12/131,660, filed on Jun. 2, 2008, entitled "Methods for Particle Removal by Single-Phase and Two-Phase Media," U.S. patent application Ser. No. 12/131,667, filed on Jun. 2, 2008, entitled "Apparatus for Particle Removal by Single-Phase and Two-Phase Media," U.S. patent application Ser. No. 12/165,577, filed on Jun. 30, 2008, and entitled "Single Substrate Processing Head for Particle Removal Using Low Viscosity Fluid," and U.S. patent application Ser. No. 12/267,345, filed on 7 Nov., 2008, entitled "Composition of a Cleaning Material for Particle Removal." The disclosure of each of these related applications is incorporated herein by reference for all purposes.

A plurality of micron-sized dry PVA particles is dispersed within the cleaning solution. The PVA particles are sponge-like in nature and include a plurality of pores 130. The PVA particles are defined by a spring factor, K, that enables the PVA particles to provide flexibility during a cleaning operation. Accordingly, the PVA particles are capable of losing their form when forced onto a material but regain their form when the PVA particles move away from the material. The size of the PVA particles is defined by the nature and composition of the PVA particles. In one embodiment, the size of the PVA particles is in the order of the size of the corresponding pores within the PVA particles. When dispersed in the cleaning solution, the PVA particles absorb the liquid of the cleaning solution, expand in size and become entrapped within the confines of the long polymeric chains of the cleaning solution.

The viscosity of the cleaning solution prior to mixing in dry PVA particles is such that it is distinctly different and higher than the viscosity of the de-ionized water (DIW). This is because when the PVA particles are added to DIW or a chemistry that exhibits viscosity similar to DIW, the PVA particles absorb the water and just settle down to the bottom of the vessel where they lump and cluster together. In the present invention, the high viscosity of the cleaning solution which is used to suspend the PVA particles prevents the PVA particles from sedimentation.

The resulting cleaning material includes uniformly suspended PVA particles, as illustrated in FIG. 1. The cleaning solution provides a medium through which the PVA particles are brought in close proximity to the contaminants on the surface of the substrate so that the PVA particles can interact with the contaminants and release the contaminants from the surface of the substrate.

In one embodiment, the cleaning material is prepared by mixing micron-sized dry PVA particles in the polymeric cleaning solution with a weight percent of about 0.1% to about 20%. In another embodiment, the weight percent of dry PVA particles to the polymer is between about 1% to about 5%. In one embodiment, the size of the dry PVA particles is in the range of about 20 microns to about 200 microns. In another embodiment, the size of the dry PVA particles is in the range of about 1 micron to about 200 microns. As the PVA particles are suspended in cleaning solution, they adsorb water and increase in size.

The cleaning material is applied using a force. The force may be associated with the dispensing of the cleaning material over the surface of the substrate. In one embodiment, an Advanced Mechanical Clean (AMC) technique is used to apply the cleaning material to the surface of the substrate. Details of an exemplary apparatus for cleaning substrate using AMC technique can be found in U.S. patent application Ser. No. 12/165,577, filed on Jun. 30, 2008, and entitled "Single Substrate Processing Head for Particle Removal Using Low Viscosity Fluid," which is incorporated herein by reference in its entirety. In this embodiment, the cleaning material may be dispensed with sufficient force so as to apply the cleaning material uniformly over the surface of the substrate. The force may include force due to relative motion of substrate corresponding to the application of the cleaning material. The force(s) brings the PVA particles proximate to the contaminants on the substrate surface. The PVA particles act as levers and exert additional sheer force on the contaminants helping to release the contaminants from the surface. The soft sponge-like nature of the PVA particles prevents damage to nearby features and devices while the PVA particles act like micro brushes on the contaminants substantially releasing them.

Figure 2A:
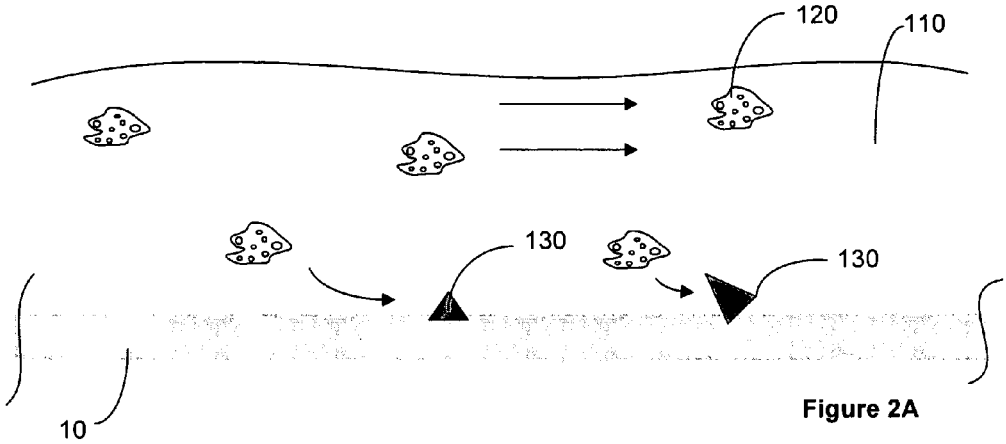
FIG. 2A illustrates a simplified physical diagram of cleaning material when applied to the surface of the substrate, in one embodiment of the invention.
Figure 2B:
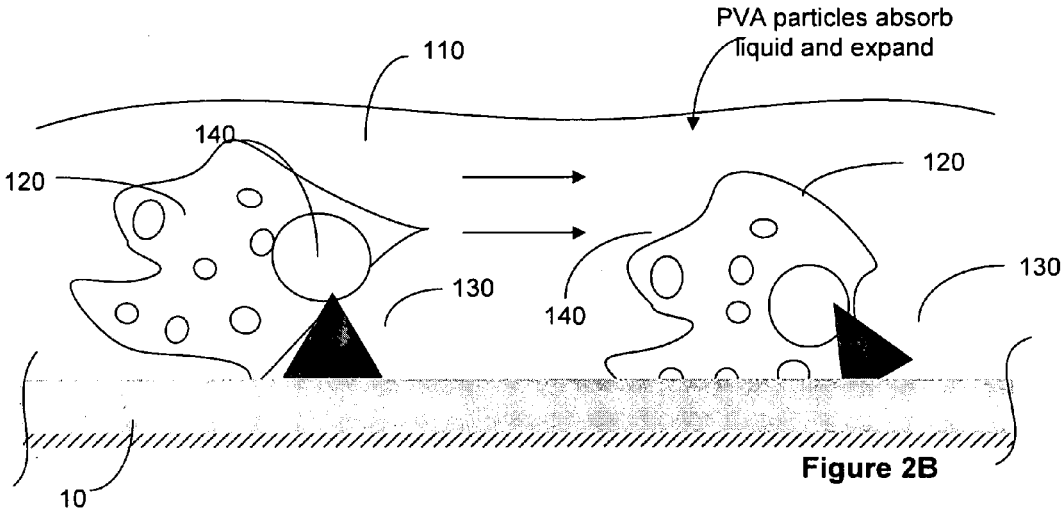
FIG. 2B illustrates a magnified view of PVA particles making contact with contaminants on the surface of the substrate, in accordance with one embodiment of the invention.
Figure 2C:
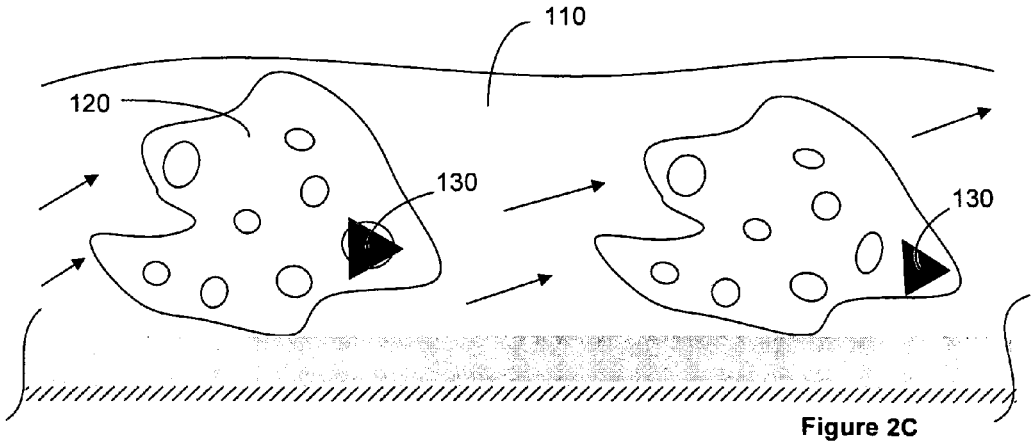
FIG. 2C illustrates a magnified view of the contaminant getting trapped in the PVA particles, in one embodiment of the invention.

FIGS. 2A through 2C illustrate the mechanism used in removing the contaminants from the surface of the substrate, in one embodiment of the invention. As shown in FIG. 2A, a cleaning material with PVA particles 120 dispersed in a cleaning solution 110 is applied to a portion of the surface of a substrate 10 using a cleaning material dispenser (not shown). The surface of the substrate 10 includes a plurality of features and devices (not shown) and a plurality of contaminants 130 that have deposited on top surface of the features/devices and in-between the features during the one or more fabrication operations that were used to form the features and devices. The cleaning material dispenser dispenses the cleaning material with a force, such as a downward force, that pushes the cleaning material onto the surface causing the PVA particles to interact with unwanted particles on the surface. In addition to the application force, other forces, such as relative motion of the substrate 10 in relation to the cleaning material dispenser, may act on the cleaning material. These forces along with viscoelastic properties enable the cleaning material to interact with at least some of the contaminants, releasing, trapping and removing the contaminants from the surface of the substrate.

In addition to the viscoelastic properties of the cleaning solution responsible for exhibiting particle removal efficiency, the PVA particles 120 suspended in the cleaning solution 110 also aid in the removal of the contaminants 130. FIGS. 2B and 2C illustrate the role of the PVA particles 120 in removing the contaminants 130 from the substrate surface. As mentioned earlier, the dry micron-sized PVA particles 120 hydrolyze using the liquid from the cleaning solution 110 and expand in size. The hydrolyzed and expanded PVA particles 120 remain suspended in the long polymeric chains of the cleaning solution 110 creating a uniform viscous cleaning material. FIGS. 2B and 2C show a magnified view of the PVA particles 120 and the contaminants 130 to better understand the role of the PVA particles 120 in the contaminant removal process. The cleaning material is applied with a sheer force that enables the PVA particles 120 to get proximate to the contaminants 130. As the PVA particles 120 get proximate to the contaminants 130, the spring factor associated with the PVA particles 120 allows the PVA particles 120 to conform to the shape of the contaminants 130, as shown in FIG. 2B. The PVA particles 120, in turn, act as levers applying additional sheer force to the contaminants 130 and helps release the contaminants from the surface of the substrate. Once released, the contaminants 130 are trapped in the polymeric chains of the cleaning material.

In one embodiment of the invention, the sponge-like nature of the PVA particles 120 enables capturing of the released contaminants 130. Upon capturing the released contaminants 130, the spring constant associated with the PVA particles 120 enables the deformed PVA particle 120 to regain its original form, as shown in FIG. 2C. The application force of the cleaning material and a relative force provided by the surface of the substrate 10 help in removing the contaminants 130 along with the cleaning material from the surface of the substrate 10, leaving behind a substantially clean substrate surface. FIGS. 2A-2C illustrate an exemplary embodiment wherein a single PVA particle interacts with a single contaminant. It should be noted that a single PVA particle may interact with a plurality of contaminants substantially removing them from the surface of the substrate.

Figure 3:
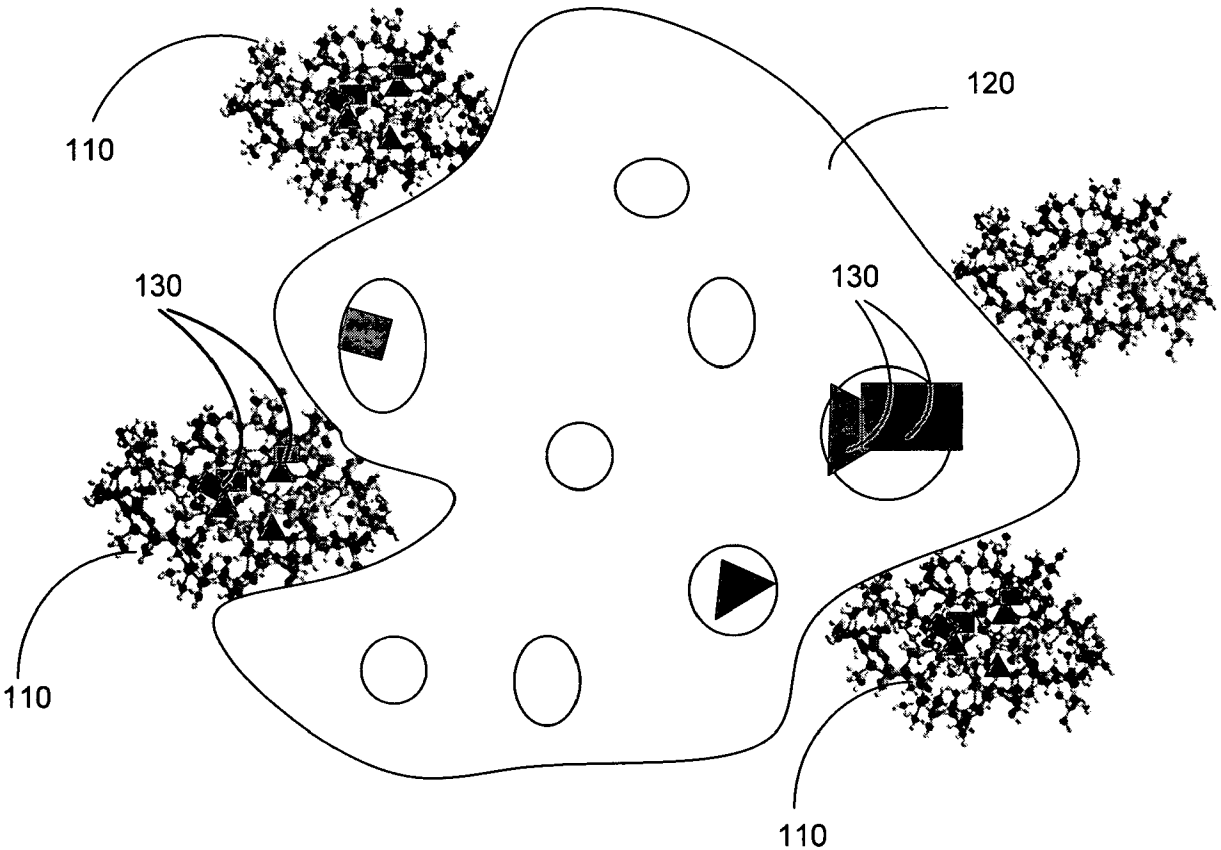
FIG. 3 illustrates a sample polymeric chain of a cleaning solution used in the removal of contaminants from the surface of the substrate, in one embodiment of the invention.

FIG. 3 illustrates another embodiment of the invention wherein the long polymeric chains of the cleaning solution 110 aid in the entrapment of the contaminants 130. It should be noted that FIG. 3 is not drawn to scale. FIG. 3 is drawn to illustrate the entrapment mechanism employed in capturing the contaminants released from the substrate surface. Further, the polymeric chain illustrated in FIG. 3 is illustrative to show the entrapment of PVA particles 120 and the contaminants 130 during a cleaning process and is not representative of any specific compound. The actual polymeric compound may be a much simpler or more complicated model with similar entrapment concept. As shown in FIG. 3, when the PVA particles 120 are added to the cleaning solution, the PVA particles 120 absorb liquid from the cleaning solution 110, expand and get trapped within the polymeric chains of the cleaning solution 110. When the cleaning material with the PVA particles 120 are applied to the substrate surface, the sheer force of the application enable the PVA particles 120 to interact with the contaminants 130. Some of the contaminants 130 are released by the interaction with the cleaning solution 110. At least some of the remaining contaminants 130 left behind are removed by the interaction with the PVA particles 120. The PVA particles 120 act as soft micro brushes that provide additional force. The PVA particles 120 act as levers and use this additional force to work on releasing some of the remaining contaminants 130 from the substrate surface. Some of the released contaminants 130 are entrapped within the polymeric chains and some within the PVA particles which are, in turn, entrapped within the polymeric chains, as shown in FIG. 3. The contaminants 130 are then removed from the substrate surface along with the cleaning material.

Figure 4:
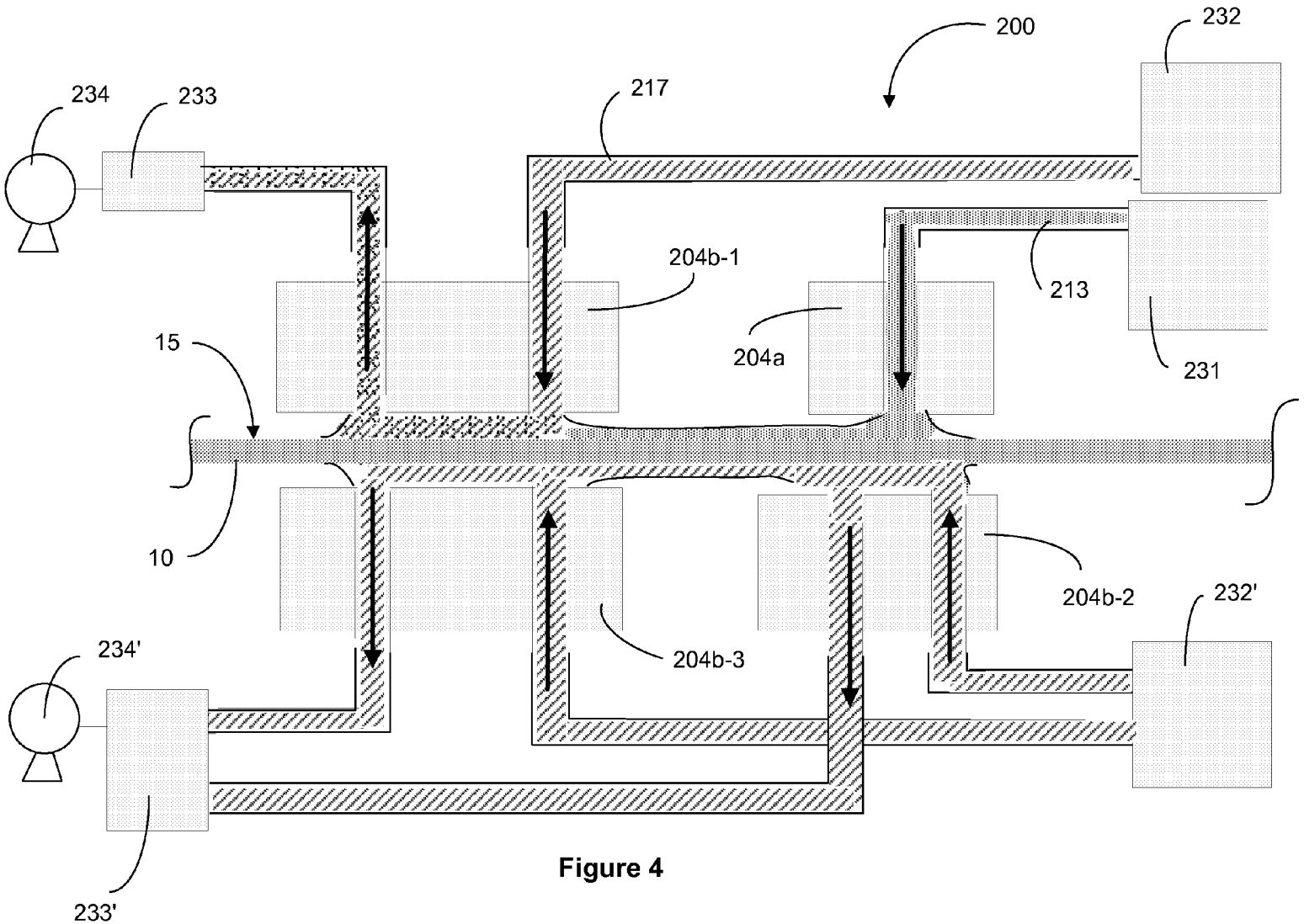
FIG. 4 illustrates a schematic diagram of an apparatus for cleaning contaminants from the surface of a substrate, in accordance with one embodiment of the invention.

The cleaning material may be supplied to a surface of the substrate using any one of a known apparatus that is used for cleaning the substrate surface. In one embodiment a proximity head is used to dispense the cleaning material to the surface of the substrate 10. FIG. 4 illustrates one such proximity head apparatus 200 for cleaning a substrate 10, in accordance with one embodiment of the present invention. The apparatus 200 includes a dispenser head, in the form of a proximity head, 204*a* for dispensing a cleaning material on a surface 15 of the substrate 10. The dispenser head 204*a* includes an inlet port 213 for delivering the cleaning material to the surface of the substrate. The size of the inlet port 213 is configured to be of size that would enable easy application of the cleaning material. In one embodiment, the size of the inlet port 213 is between about 0.875 mm to about 1 mm. The dispenser head 204*a* is coupled to a cleaning material storage 231 that supplies the cleaning material to the substrate surface. In one embodiment, the dispenser head 204*a* is held in proximity to the surface 15 of the substrate 10. Details of an exemplary apparatus for cleaning substrate using a proximity head(s) can be found in U.S. patent application Ser. No. 12/165,577, filed on Jun. 30, 2008, and entitled "Single Substrate Processing Head for Particle Removal Using Low Viscosity Fluid," which is incorporated herein by reference in its entirety.

To ensure that viscoelastic properties of the cleaning solution are fully utilized to provide maximum particle removal efficiency, the rinsing the cleaning solution off the wafer surface should be performed in an optimized manner. Confined Chemical Cleaning (C3) head provides the most effective way for removal of the cleaning media off the surface of the substrate. For more information on C3 head and the cleaning solution reference can be made to U.S. patent application Ser. No. 12/131,654, filed on Jun. 2, 2008, entitled "Materials for Particle Removal by Single-Phase and Two-Phase Media," U.S. patent application Ser. No. 12/131,660, filed on Jun. 2, 2008, entitled "Methods for Particle Removal by Single-Phase and Two-Phase Media," U.S. patent application Ser. No. 12/131,667, filed on Jun. 2, 2008, entitled "Apparatus for Particle Removal by Single-Phase and Two-Phase Media," which are incorporated herein by reference. The DIW rinse meniscus interface realized by C3 head provides the pooling force on the cleaning solution enabling particle removal off the surface of substrate due to viscoelastic properties of the fluid. Having two phased flow (liquid+air) on the meniscus interface is critical for achieving maximum particle removing efficiency.

Optionally, the apparatus may also include a rinse and dry head 204*b*-1 for rinsing and drying the surface 15 of the substrate 10. The rinse and dry head 204*b*-1 is coupled to a rinse liquid storage 232, which provides a rinse liquid through a second inlet port 217 for rinsing the substrate surface 15 covered by a film of cleaning material dispensed by the dispenser head 204*a*. In addition, the rinse and dry head 204*b*-1 is coupled to a waste storage 233 and a vacuum 234. The waste storage 233 receives and holds a mixture of cleaning material with contaminants removed from the substrate surface 15 and rinse liquid dispensed by the rinse and dry head 204*b*-1.

In one embodiment, the substrate 10 is received, supported and transported under the dispenser head 204*a* and rinse and dry head 204*b*-1 using a substrate supporting mechanism (not shown). The surface 15 of substrate 10 is first treated by the cleaning material as it moves under the dispenser head 204*a*. The cleaning material is dispensed as a thin film to cover at least a portion of the substrate surface 15. The substrate surface 15 is then rinsed and dried using the rinse liquid dispensed by the rinse and dry head 204*b*-1. The force of application of the cleaning material and the relative motion of the substrate with respect to the application of the cleaning material create the sheer force that enables the PVA particles to move proximate to and interact with the contaminants. The PVA particles in the cleaning material act as soft micro brushes providing additional energy to the surface 15 of the substrate 10. The PVA particles work as levers applying the additional energy on the contaminants and help in releasing the contaminants from the substrate surface 15.

Alternatively, substrate 205 can be held steady (stationary) and the dispenser head 204*a* and the rinse and dry head 204*b*-1 are moved. As mentioned in the embodiment with moveable substrate, the additional force provided by the moving dispenser head and the rinse and dry head help the PVA particles to act on the contaminants and release the contaminants from the surface of the substrate.

In one embodiment, the dispenser head 204*a* and the rinse and dry head 204*b*-1 belong to a single system. In this embodiment, the substrate supporting mechanism is used to move the substrate 10 first under the dispenser head 204*a* where the cleaning material is dispensed and then under the rinse and dry head 204*b*-1 where a rinse liquid is dispensed and removed along with the cleaning material and the contaminants. In another embodiment, the dispenser head 204*a* and the rinse and dry head 204*b*-1 belong to two separate systems. Cleaning material is dispensed on the surface 15 of the substrate 10 in a first system with the dispenser head 204*a* by moving the substrate under the dispenser head 204*a*. The substrate is then moved to a second system with a rinse and dry apparatus. In one embodiment, the rinse and dry apparatus is a rinse and dry head 204*b*-1. The embodiments are not restricted to proximity heads but can include other apparatus to dispense cleaning material and rinse liquid.

In one embodiment, in addition to the dispenser head 204*a* and the rinse and dry head 204*b*-1 that supply the cleaning material and rinse liquid to a top surface of the substrate, additional dispenser heads and/or rinse and dry heads may be provided to cover the bottom surface of the substrate 10. FIG. 4 illustrates one such embodiment. As illustrated in FIG. 4, there are two additional rinse and dry heads 204*b*-2 and 204*b*-3 provided below the surface 10 to clean the underside surface of the substrate. In one embodiment, the two lower rinse and dry heads 204*b*-2 and 204*b*-3 are coupled to a corresponding rinse liquid storage 232', a waste storage 233' and a vacuum (pump) 234', as shown in FIG. 4. In another embodiment, each of the lower rinse and dry heads 204*b*-2 and 204*b*-3 are coupled to separate rinse liquid storages, separate waste storages and separate vacuum pumps. In yet another embodiment, a combined rinse liquid storage is used to supply rinse liquid to both the top and underside of the substrate 10. Similarly, a combined waste storage and combined vacuum pump may provide the waste receptacle and vacuum for both the top and bottom surfaces of the substrate.

Variations to the location of the various cleaning material dispenser 204*a*, rinse and dry heads 204*b*-1, 204*b*-2, 204*b*-3, etc., may be provided, as is well known in the art. The location of the various dispensers and rinse and dry heads may be independent of each other or may depend on the location of one another.

Figure 5:
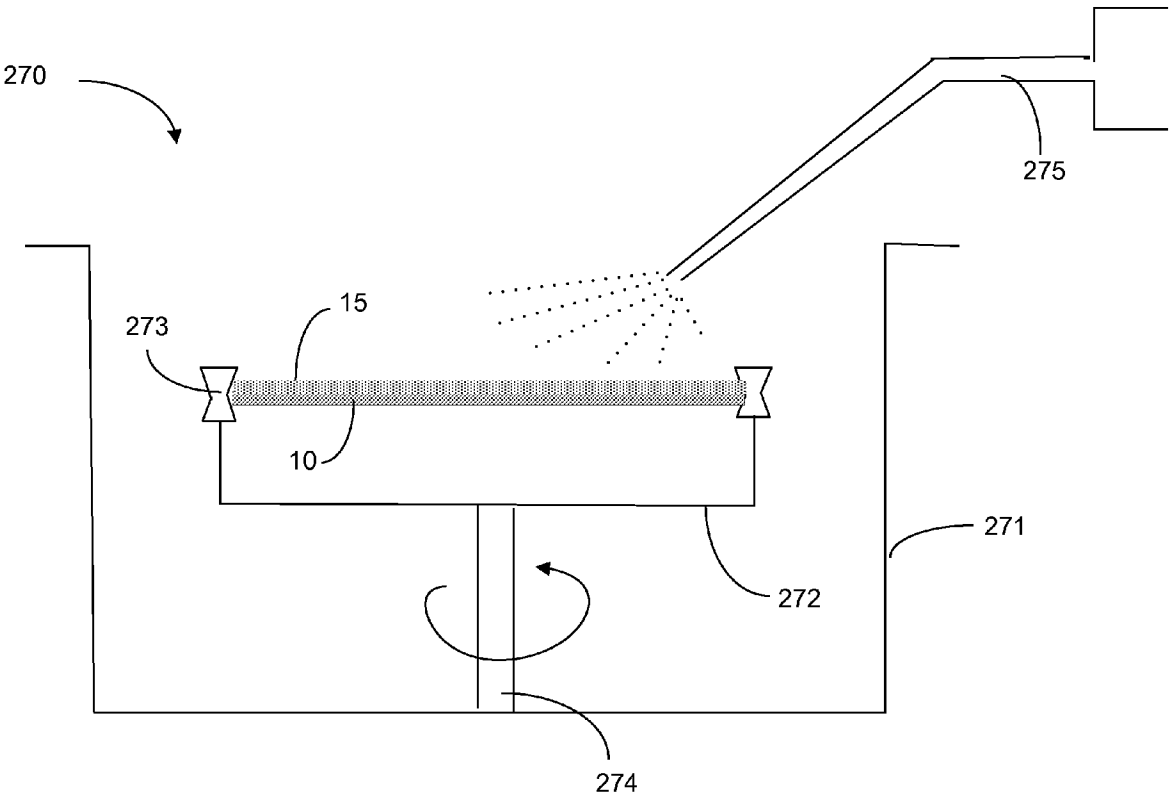
FIG. 5 illustrates an alternate embodiment of an apparatus used for cleaning contaminants from the surface of a substrate, in one embodiment of the invention.

FIG. 5 shows a schematic diagram of a cleaning chemistry dispenser apparatus, in an alternate embodiment. The dispenser apparatus 270 has a container 271 that houses a substrate support assembly 272. The substrate support assembly 272 has a substrate holder 273 that supports a substrate 10. A dispenser arm 275 coupled to a cleaning chemistry storage unit (not shown) is used to provide cleaning chemistry to the surface of the substrate 10. The dispenser arm 275 includes a dispense outlet that is configured to be large enough to enable easy application of the cleaning material. The substrate support assembly 272 is coupled to a rotating mechanism 274 to rotate the substrate supported on the substrate holder 273. The dispenser arm may be a moveable arm that is moved into position so as to apply the cleaning material to the surface of the substrate. The combined force of application and the relative motion of the substrate provide the energy for the PVA particles to interact with the contaminants. The additional sheer force provided by the PVA particles act as levers to release the contaminants from the substrate surface. The released contaminants are either captured within the PVA particles or within the long polymeric chains of the cleaning solution and are removed along with the cleaning material. PVA particles suspended in cleaning media reach contaminant particles on top of the features and in some cases, in-between features and act as soft micro brushes that successfully act on the contaminants without damaging the features/devices formed nearby so that a thorough cleaning can be achieved.

In one embodiment, the dispenser arm used to supply the cleaning material may also be used to supply rinse liquid to the surface of the substrate after the cleaning operation. In this embodiment, the dispenser arm may include a switching mechanism to switch the supply of cleaning material with that of rinse liquid. In an alternate embodiment, a second dispenser arm may be used to supply a rinse liquid to rinse and remove the cleaning material from the substrate surface 15.

The above embodiments describe a cleaning technique that provides enhanced cleaning using a polymeric cleaning solution, by mixing a plurality of micron-sized PVA particles. PVA material is well known in the industry as a cleaning aid. Conventional cleaning techniques used the PVA material in a roller brush. The biggest drawback from using PVA brush is the introduction of mechanical damage to the features. The PVA roller clean is a contact cleaning method. During cleaning process the roller touches the semiconductor substrate and provides pressure to the substrate. While this technology may be very effective in removing particles from planar surfaces, the forces introduced to the features often introduce mechanical damage to the features and thus can not be used to clean substrates with geometries. In the current embodiments the PVA particles are trapped within the confines of the long polymeric chains of the cleaning solution. The PVA particles provide the sheer force that works to overcome the bonding force between the contaminants and the surface of the substrate. The main advantage of this application is that due to the size of the PVA particles dispersed in the cleaning solution of the cleaning material and due to the force of application, the cleaning material removes particles off the surface of the substrate without mechanical damage. The PVA particles successfully work to release the contaminants from the surface.

The selection of the cleaning solution and the appropriate PVA particles is based on the type of contaminants and a plurality of process parameters associated with the devices/features. The process parameters may be obtained by analyzing various fabrication layers that form the features/devices. The process parameters define characteristics of the contaminants and each of the devices/features. Some of the process parameters associated with each of the features/devices and the contaminants include one or more of type, size, and composition. Optimal cleaning is obtained when about 0.5 μm to about 200 μm sized PVA particles are dispersed in the cleaning solution with a weight percent of about 0.1% to about 20% and applied using a flow rate of about 15-1500 ml/min. The cleaning material can be applied at room temperature to obtain the optimal clean.

Figure 6:
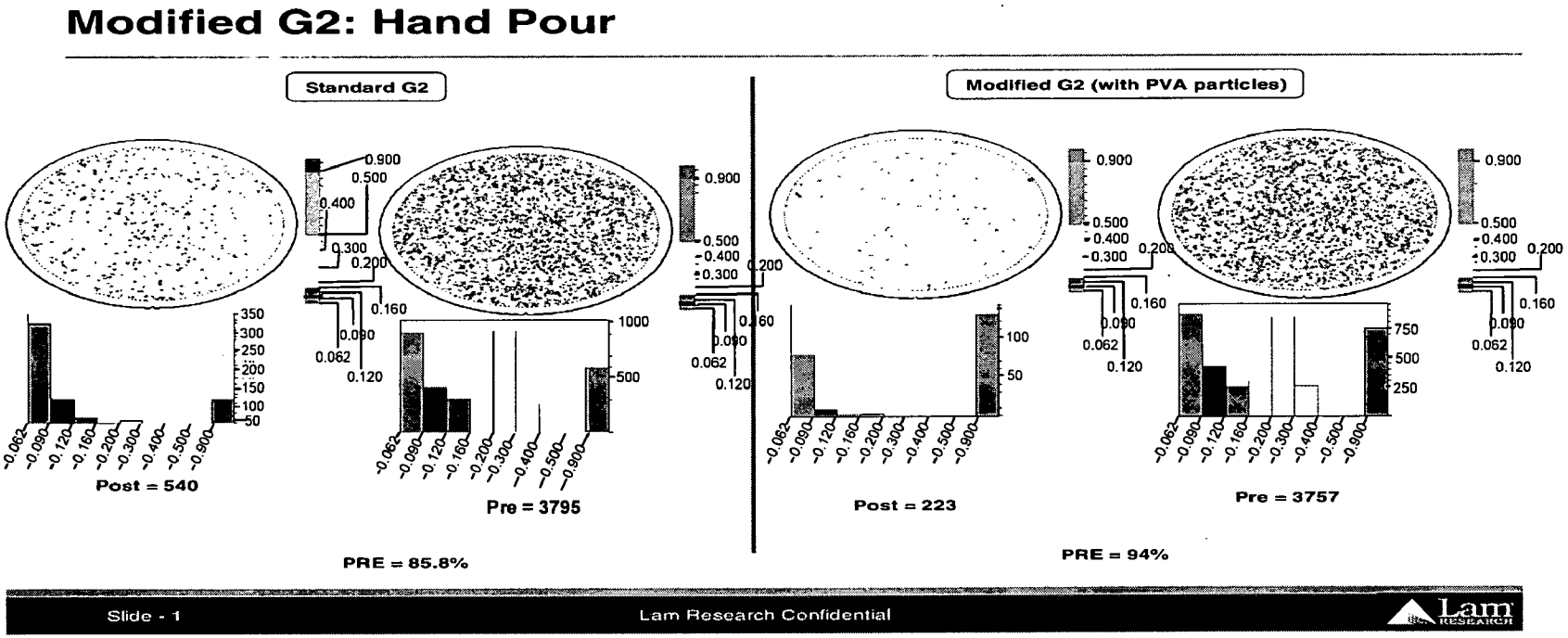
FIG. 6 illustrates particle removal efficiency (PRE) using a standard cleaning material and an enhanced cleaning material in one embodiment of the invention.

FIG. 6 shows particle removal efficiency (PRE) and number of contaminants left behind after the cleaning process, in one embodiment of the invention. The cleaning material is prepared by mixing about 1%-to about 20% by weight of PVA particles in cleaning solution. PRE is measured by using particle monitor substrates, which are purposely deposited with silicon nitride particles of varying sizes. A clean silicon substrate is used. Silicon nitride is deposited on the silicon substrate. The amount of silicon nitride particles deposited on the substrate are measured after the deposition. The substrate is then cleaned first with a cleaning material and the amount of silicon nitride particles is measured after the clean. PRE is then calculated using a standard formula identified below. The PRE is calculated for a substrate after treatment with the cleaning solution and after treatment with cleaning material wherein the cleaning solution is enhanced by dispersing PVA particles in the cleaning solution. PRE is calculated by equation (1) listed below:

$$PRE=(\text{Pre-clean counts}-\text{Post-clean counts})/\text{Pre-clean counts} \quad (1)$$

The substrates with SiN particles are scanned to measure the particle counts pre and post cleaning with standard and enhanced cleaning solution so as to compare the effects of the enhanced cleaning solution on the cleaning. As can be seen from FIG. 6, the PRE for standard cleaning solution is about 85.8% as compared to the PRE for enhanced cleaning solution which is about 94%, clearly indicating that the enhanced cleaning solution is more effective in removing contaminants from the surface of the substrate. The polymeric chains and network of the cleaning solution in the cleaning material help capture and entrap contaminants released from the substrate surface thereby preventing the contaminants from being deposited or re-deposited on the substrate surface and the PVA particles play a role in more efficiently cleaning contaminants on the substrate surface.

Figure 7:
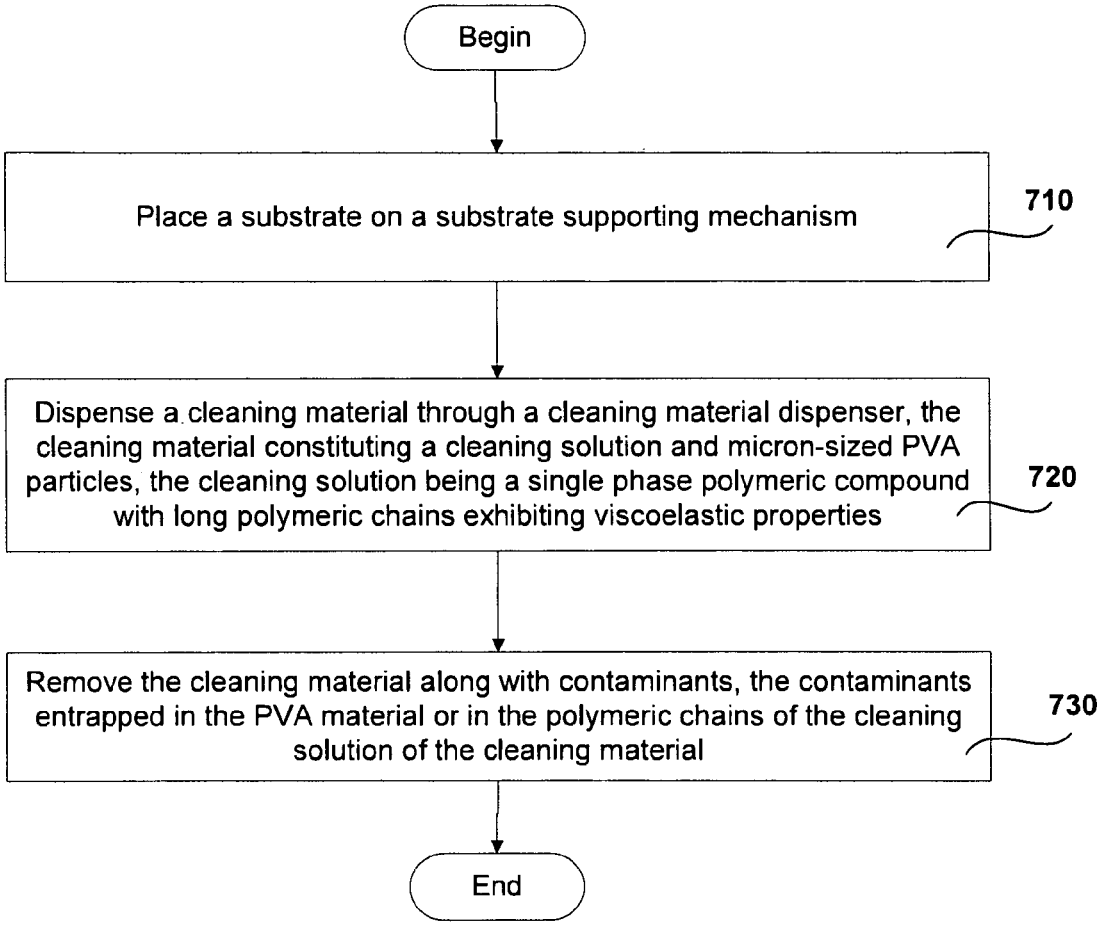
FIG. 7 illustrates a flowchart of operations used in applying enhanced cleaning material to the surface of the substrate, in accordance with one embodiment of the invention.

FIG. 7 shows a process flow for cleaning a substrate using a cleaning material with a plurality of micron-sized PVA particles dispersed therein, in accordance with one embodiment of the present invention. The substrate is a patterned substrate with features/devices protruding from the substrate surface. The process beings with a substrate to be cleaned being placed in a cleaning apparatus, as illustrated in operation 710. The substrate can be placed on a substrate supporting mechanism that moves the substrate through the cleaning apparatus or is stationary with one or more dispensers moving in relation to the substrate. At operation 720, the cleaning material is dispensed onto the surface of the substrate. The cleaning material includes a cleaning solution with distinct viscoelastic properties. Additionally, the cleaning material is chosen such that it is a single phase polymeric compound with long polymeric chains. A plurality of micron-sized dry PVA particles are dispersed within the cleaning solution. The dry PVA particles absorb liquid from the cleaning solution, expand and get suspended uniformly within the polymeric chains of the cleaning solution.

The substrate cleaning method also includes applying a force to the PVA particles to bring the PVA particles within proximity to a contaminant present on the substrate, such that an interaction is established between the PVA particles and the contaminants. In one embodiment, the force is applied on the PVA particles when the cleaning material is dispensed on the substrate surface. In another embodiment, the force is applied on the PVA particles when the cleaning material is dispensed on the substrate surface and also when the rinse liquid is applied on the substrate surface. In this embodiment the force applied on the substrate surface during rinsing also help to bring the PVA particles closer to the contaminants to establish an interaction between the PVA particles and the contaminants.

In one embodiment, the flow rate of the cleaning material over the substrate is controlled so as to enhance the force of application of the cleaning material to enable PVA particles to interact with the contaminants. The method of the present invention for removing contamination from a substrate can be implemented in many different ways so long as there is a means for applying a force to the PVA particles of the cleaning material such that the PVA particles establish an interaction with the contaminants to be removed.

The PVA particles act as soft micro brushes that provide additional force. The additional force enables the PVA particles to act as levers helping in the release of the contaminants from the substrate surface. The released contaminants are trapped within the PVA particles or within the long polymeric chains of the cleaning material. At operation 730, the cleaning chemistry with the entrapped contaminants are promptly removed from the surface of the substrate, leaving behind a substantially clean surface.

In one embodiment, the cleaning material with the entrapped contaminants is removed by applying vacuum. In another embodiment, a rinse liquid is dispensed and promptly removed from the surface of the substrate. During the removal of the rinse liquid, the cleaning material with the contaminants is also promptly removed. The contaminants on the patterned substrate to be removed can essentially be any type of surface contaminant associated with the semiconductor wafer fabrication process, including but not limited to particulate contamination, trace metal contamination, organic contamination, photoresist debris, contamination from wafer handling equipment, wafer bevel edge contamination and wafer backside particulate contamination.

In the embodiment where rinse liquid is used to remove the cleaning material with the contaminants, the rinse liquid is carefully selected to facilitate efficient removal of the cleaning material with the contaminants. The rinse liquid, in this embodiment, is selected such that the selected rinse liquid and its delivery method complements the cleaning material used in the cleaning operation. The rinse liquid for the rinse operation 730 can be any liquid, such as DIW or other liquid, that facilitates thorough removal of the cleaning material without leaving any chemical residue on the substrate surface. In one embodiment, the rinse liquid is applied through Confined Chemical Cleaning (C3) Head. However there are various ways in which rinse liquid can be implements onto the wafer to achieve maximum particle removal efficiency.

For more information on a substrate supporting device, such as a wafer carrier, reference can be made to U.S. patent application Ser. No. 11/743,516, entitled "Hybrid Composite Wafer Carrier for Wet Clean Equipment", filed on May 2, 2007, and assigned to the Assignee of the subject application and is incorporated herein by reference.

For additional information with respect to the proximity head, reference can be made to an exemplary proximity head, as described in the U.S. Pat. No. 6,616,772, issued on Sep. 9, 2003 and entitled "Methods for wafer proximity cleaning and drying." This U.S. patent, which is assigned to Lam Research Corporation, the assignee of the subject application, is incorporated herein by reference.

For additional information about menisci, reference can be made to U.S. Pat. No. 6,998,327, issued on Jan. 24, 2005 and entitled "METHODS AND SYSTEMS FOR PROCESSING A SUBSTRATE USING A DYNAMIC LIQUID MENISCUS," and U.S. Pat. No. 6,998,326, issued on Jan. 24, 2005 and entitled "PHOBIC BARRIER MENISCUS SEPARATION AND CONTAINMENT." These U.S. patents, which are assigned to the assignee of the subject application, are incorporated herein by reference in their entirety for all purposes.

For additional information about top and bottom menisci, reference can be made to the exemplary meniscus, as disclosed in U.S. patent application Ser. No. 10/330,843, filed on Dec. 24, 2002 and entitled "Meniscus, Vacuum, IPA Vapor, Drying Manifold." This U.S. patent, which is assigned to Lam Research Corporation, the assignee of the subject application, is incorporated herein by reference.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention. In the claims, elements and/or steps do not imply any particular order of operation, unless explicitly stated in the claims.

What is claimed is:

1. A cleaning material to remove contaminants from a semiconductor substrate surface, comprising:

a cleaning solution having viscoelastic properties, the cleaning solution being a single phase mixture of polymeric compound having polymers with long polymeric chains defined by a molecular weight that is greater than about 10,000 g/mol, deionized water and one or more additives; and a plurality of polyvinyl alcohol (PVA) particles dispersed in the cleaning solution to form the cleaning material, the polyvinyl alcohol particles range between about 0.5 micron to about 200 microns in dimension, each polyvinyl alcohol particle having a spring factor that allows the polyvinyl alcohol particle to lose its form when the cleaning material is applied to the substrate surface with a force and regain its form when the force is removed, the PVA particles include a plurality of pores, size of the pores varying based on chemical composition of the PVA particles, wherein the polyvinyl alcohol particles absorb liquid of the cleaning solution and become uniformly suspended within the long polymeric chains of the cleaning material, wherein the polyvinyl alcohol particles suspended uniformly in the cleaning material interact with at least some of the contaminants to release the contaminants from the surface of the substrate and wherein the released contaminants are entrapped within the polyvinyl alcohol particles and within the long polymeric chains of the cleaning material.

2. The cleaning material of claim 1, wherein the contaminants released from the surface of the substrate are captured within the plurality of pores of the PVA particles suspended in the cleaning material.

3. The cleaning material of claim 1, wherein the contaminants released from the surface of the substrate are captured within the long polymeric chains of the cleaning material.

4. The cleaning material of claim 1, wherein the PVA particles are defined by a spring constant, the spring constant providing the PVA particles with flexibility to deform and to regain shape during application of the cleaning material.

5. The cleaning material of claim 1, wherein the suspension of the PVA particles in the cleaning solution is through absorption of aqua component of the cleaning solution by the PVA particles, expansion of the PVA particles and entrapment of the PVA particles within the long polymer chains of the cleaning solution, the entrapped PVA particles acting as soft micro brushes when interacting with the contaminants thereby preventing damage to the features formed on the surface of the substrate.

6. The cleaning material of claim 1, wherein the PVA particles along with the cleaning material deforms around semiconductor devices formed on the substrate due to application of a force on the cleaning material applied to the surface of the substrate, the PVA particles providing additional shear force during interaction to dislodge the contaminants from the surface of the substrate without causing mechanical damage to the features.

7. The cleaning material of claim 1, wherein the size of the PVA particles suspended in the cleaning material is defined by size of the pores such that the size of the PVA particles is larger than the corresponding pores so as to maintain structural integrity and functionality of the PVA particles.

8. The cleaning material of claim 7, wherein the size of the PVA particles is between about 20 micro meter to about 200 micrometer.

9. The cleaning material of claim 1, wherein the cleaning material is made of PVA particles with a weight percent in the range of about 1% to about 5%.

10. The cleaning material of claim 1, wherein the cleaning material is made of PVA particles with a weight percent in the range of about 0.1% to about 20%.

11. The cleaning material of claim 1, wherein the size of the PVA particles ranges between about 45 microns to about 150 microns.

12. An apparatus for cleaning contaminants from a surface of a semiconductor substrate, comprising:

a substrate supporting mechanism to receive, hold and transport the substrate along a plane; and a cleaning material dispenser for applying a cleaning material to the surface of the semiconductor substrate, wherein the cleaning material contains, a cleaning solution having viscoelastic properties, the cleaning solution being a single phase polymeric compound having polymers with long polymeric chains defined by a molecular weight that is greater than about 10,000 g/mol;

a plurality of polyvinyl alcohol (PVA) particles dispersed in the cleaning solution to form the cleaning material, each of the polyvinyl alcohol particles range between about 0.5 micron to about 200 microns in dimension, each polyvinyl alcohol particle having a spring factor that allows the polyvinyl alcohol particle to lose its form when the cleaning material is applied to the substrate surface with a force and regain its form when the force is removed, the PVA particles include a plurality of pores, size of the pores varying based on chemical composition of the PVA particles, wherein the polyvinyl alcohol particles absorb liquid of the cleaning solution and become uniformly suspended within the long polymeric chains of the cleaning material, wherein the polyvinyl alcohol particles suspended uniformly interact with at least some of the contaminants to release the contaminants from the surface of the substrate and wherein the released contaminants are entrapped within the polyvinyl alcohol particles and within the long polymeric chains of the cleaning material.

13. The apparatus of claim 12, wherein the cleaning material dispenser is a proximity head with a delivery hole to dispense the cleaning material, size of the delivery hole of the dispense head being larger than a size of the PVA particles to enable application of the cleaning material to the surface of the substrate.

14. The apparatus of claim 13, wherein the size of the delivery hole is between about 0.875 mm to about 10 mm.

15. The apparatus of claim 13, wherein the semiconductor substrate moves under the proximity head, the movement of the semiconductor substrate introducing a shear force between the cleaning material and the surface of the substrate, the PVA particles within the cleaning material providing additional shear force to release the contaminant from the surface of the substrate.

16. The apparatus of claim 12, wherein the cleaning material dispenser is a jet.

* * * * *